United States Patent [19]

Kawakami

[11] Patent Number: 4,720,202

[45] Date of Patent: Jan. 19, 1988

[54] PRINT RIBBON REPLACEABLE CASSETTE

[75] Inventor: Masanori Kawakami, Ebina, Japan

[73] Assignee: Ricoh Company, Ltd., Tokyo, Japan

[21] Appl. No.: 786,216

[22] Filed: Oct. 10, 1985

[30] Foreign Application Priority Data

Oct. 12, 1984 [JP] Japan ..... 59-213774

[51] Int. Cl.[4] ..... B41J 32/00

[52] U.S. Cl. ..... 400/208; 400/236; 242/192

[58] Field of Search ..... 400/207, 208, 208.1, 400/235, 236; 242/192

[56] References Cited

U.S. PATENT DOCUMENTS

| | | | |
|---|---|---|---|
| 2,743,878 | 5/1956 | Masterson | 242/192 |
| 2,891,736 | 6/1959 | Blaes | 242/192 |
| 3,672,754 | 6/1972 | Riedel | 242/192 X |
| 4,072,279 | 2/1978 | Lewis | 242/192 |
| 4,159,811 | 7/1979 | Grant | 242/192 |
| 4,242,709 | 12/1980 | Stricker | 242/192 X |
| 4,264,224 | 4/1981 | Mathews | 400/208 X |
| 4,265,552 | 5/1981 | Bemis et al. | 400/208 X |
| 4,359,288 | 11/1982 | Bullock | 400/208 |

FOREIGN PATENT DOCUMENTS

| | | | |
|---|---|---|---|
| 698262 | 1/1931 | France | 242/192 |
| 0033974 | 4/1981 | Japan | 400/208.1 |
| 0038181 | 3/1982 | Japan | 400/236 |
| 0071883 | 4/1984 | Japan | 400/235 |

OTHER PUBLICATIONS

IBM Technical Disclosure Bulletin, "Peripheral Printer Ribbon Drive Mechanism", Firth et al., vol. 22, No. 3 Aug. 1979, p. 875.

IBM Technical Disclosure Bulletin," Variable Tension Peripheral Belt Drive For Ribbon," Bullock et al., vol. 23 No. 2 Jul. 1980, pp. 433–434.

*Primary Examiner*—Ernest T. Wright, Jr.

*Attorney, Agent, or Firm*—Cooper, Dunham, Griffin & Moran

[57] ABSTRACT

A print ribbon cassette includes a supply roll and a take-up roll so that the print ribbon unwound from the supply roll is presented for use in printing and thereafter wound around the take-up roll. The cassette also includes an endless belt extended around a driving roller and a pair of belt rollers. The driving roller is provided fixed in position and coupled to a driving motor of a printer when the cassette is mounted on the printer. On the other hand, the belt rollers are rotatably mounted on separate support arms which are pivotally mounted on the cassette. When the support arms are located at an operative position as extending substantially in a line and opposite in direction, the belt is brought into driving engagement with both of the supply and take-up rollers. When the support arms are located at an inoperative position as extending substantially in the same direction, the belt is effectively disengaged from both of the supply and take-up rollers, thereby allowing both of the supply and take-up rollers to be replaced with ease.

8 Claims, 4 Drawing Figures

PRINT RIBBON REPLACEABLE CASSETTE

BACKGROUND OF THE INVENTION

1. Field of the Invention

This invention generally relates to a print ribbon cassette for use in various types of printers and typewriters, and, in particular, to a print ribbon replaceable cassette employing an elastic driving belt for carrying out ribbon feed.

2. Description of the Prior Art

FIG. 3 shows a typical prior art print ribbon cassette 10 capable of replacing used print ribbon with fresh print ribbon. As shown, a print ribbon 12 is wound around a supply reel 11 thereby forming a supply roll 13 of print ribbon 12 as housed inside of the cassette 10. A fan-shaped supply plate 14 is pivotally supported on a base plate 10*a* of the cassette 10 so as to be pivotal around a roller shaft 15*a* of a roller 15, and the supply reel 11 is rotatably supported on the fan-shaped supply plate 14. The print ribbon 12 is lead out of the supply roll 13 and passed around a pair of guide rollers 16, 16 mounted on the base plate 10*a* of cassette 10, and, then, the print ribbon 12 extends outside of the cassette 10 and, after passing around another pair of guide rollers 17, 17, it is wound around a take-up reel 18 so that a take-up roll 19 is formed around the take-up reel 18. The take-up reel 18 is rotatably supported on a fan-shaped take-up plate 20 which, in turn, is pivotally supported on the base plate 10*a* of the cassette 10 so as to be pivotal around a roller shaft 21*a* of a roller 21.

As shown in FIG. 3, the rollers 15 and 21 are freely rotatably mounted on and located at respective corners of the base plate 10*a* of the cassette 10 and a drive roller 22 is also provided as rotatably mounted on and located near the center of the cassette 10 so that a triangular shape is defined by these three rollers 15, 21 and 22 with one side extending in parallel with and adjacent to the bottom side of the base plate 10*a* of the cassette 10. As shown, the rollers 15 and 22 are located on opposite sides of the supply roll 13, and the rollers 21 and 22 are located on opposite sides of the take-up roll 19. The drive roller 22 is coupled to a driving mechanism (not shown) of a printer when the cassette 10 is detachably mounted on the printer so that the drive roller 22 may be driven to rotate. An endless, elastic belt 23 extends around these three rollers 15, 21 and 22 and is in pressure contact with the supply and take-up rolls 13 and 19. The drive roller 22 is driven to rotate clockwise so that the endless belt 23 advances in the direction indicated by the arrows a to carry out ribbon feed.

In the case of the print ribbon cassette 10, when a top cover (not shown) is removed, the fan-shaped plates 14 and 20 may be pivotted outwardly as indicated by the one-dotted lines thereby releasing the pressure contact between the endless belt 23 and each of the supply and take-up rolls 13 and 19 whereby replacement of print ribbons may be carried out with ease. However, after print ribbon replacement, when the fan-shaped plates 14 and 20 are pivotted back to their original positions inside of the cassette 10, the supply roll 13 tends to rotate counterclockwise and the take-up roll 19 tends to rotate clockwise due to friction with the endless belt 23 so that there is produced a slack in the print ribbon 12 as illustrated in FIG. 4. When such a slack is produced in the print ribbon 12, it cannot be eliminated easily.

SUMMARY OF THE INVENTION

In accordance with the present invenrion, there is provided a print ribbon cassette including a base plate on which a print ribbon supply roll and a print ribbon take-up roll are rotatably mounted; a drive roller rotatably mounted on the base plate; a pair of belt rollers each of which is rotatably mounted on a support arm which, in turn, is pivotally mounted on the base plate between a first and second positions; and an endless belt extended around the drive and pair of belt rollers, whereby the belt is brought into driving contact condition with the supply and take-up rolls when the support arms are located at the first position and disengaged from the driving contact condition when the support arms are located at the second position. In this manner, in accordance with the preferred embodiment of the present invention, the print ribbon supply and take-up rolls are rotatably mounted on the base plate of the cassette at respective fixed positions, whereas the pair of belt rollers are mounted on the respective pivotal support arms which are pivotally supported by a common pivot axis planted in the base plate so that the belt rollers may be pivotted to move closer together or separated away from each other depending on the direction of pivotal motion.

It is therefore a primary object of the present invention to obviate the disadvantages of the prior art as described above and to provide an improved print ribbon cassette.

Another object of the present invention is to provide a print ribbon replaceable cassette capable of replacing the print ribbon in use with a fresh print ribbon without causing any inconveniences.

A further object of the present invention is to provide a print ribbon replaceable cassette which allows to carry out a print ribbon replacing operation speedily and with ease.

A still further object of the present invention is to provide a print ribbon cassette capable of insuring that the print ribbon is properly set in tension when it is set in position.

Other objects, advantages and novel features of the present invention will become apparent from the following detailed description of the invention when considered in conjunction with the accompanyiny drawings.

DESCRIPTION OF THE PREFERRED EMBODIMENTS

Figure 1:
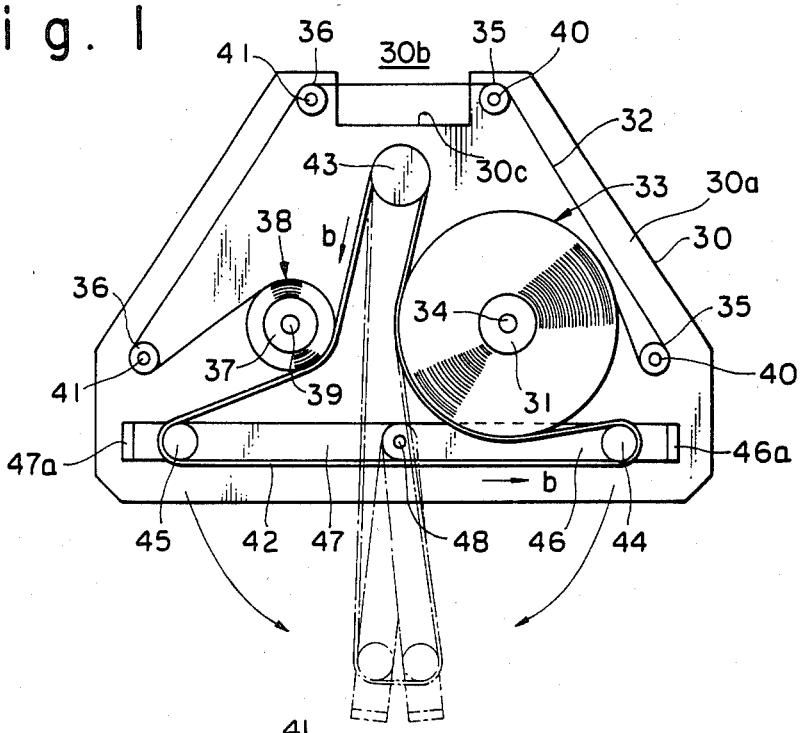
FIG. 1 is a schematic illustration showing a print ribbon replaceable cassette constructed in accordance with one embodiment of the present invention.

Referring now to FIG. 1, there is schematically shown a print ribbon replaceable cassette 30 constructed in accordance with one embodiment of the present invention. It is to be noted that the cassette 30, in fact, includes a base plate 30*a* having a generally triangular contour and a correspondingly shaped cover plate (not shown) which is provided with a side wall (not shown) so that there is defined an enclosed spacve when the top cover plate is placed in position on the base plate 30*a*. A supply reel 31 is rotatably mounted on the base plate 30*a* of the cassette 30 as fitted onto a supply shaft 34 planted in the base plate 30*a* and a print ribbon 32 is wound around the supply reel 31 to define a supply roll 33 of the print ribbon 32. Thus, when the supply roll 33 rotates clockwise, the print ribbon 32 is unwound from the supply roll 33 to be fed for use in printing.

A pair of guide rollers 35, 35 are disposed as rotatably fitted onto respective guide shafts 40, 40 which are planted in the base plate 30*a* of the cassette 30. These guide rollers 35, 35 are so located to guide the print ribbon 32 unwound from the supply roll 33 to reach a printing section 30*b*, which is defined as a recess 30*c* in the base plate 30*a* of the cassette 30. At the printing section 30*b*, the print ribbon 32 is lead outside of the cassette 30 and extends across the printing section 30*b* to be again lead into the interior of the cassette 30. Another pair of guide rollers 36, 36 are disposed as rotatably fitted onto respective guide shafts 41, 41 which are also planted in the base plate 30*a* of the cassette 30. These guide rollers 36, 36 are so located to guide the print ribbon 32 extending across the printing recess 30*c* to reach a take-up reel 37 which is rotatably fitted onto a take-up shaft 39 planted in the base plate 30*a* of the cassette 30. And, thus, after passing around the guide rollers 36, 36, the print ribbon 32 is wound around the take-up reel 37 to define a take-up roll 38. As described above, that portion of the print ribbon 32 extending between the guide rollers 35 and 36 located on opposite ends of the printing recess 30*c* is used for printing. Thus, is printing proceeds, the print ribbon 32 is unwound from the supply roll 33 to be wound around the take-up roll 38 whereby the print ribbon 32 is present for use in printing while advancing across the printing section 30*b* defined between the opposed guide rollers 35 and 36.

The cassette 30 also includes a drive roller 43 which is rotatably mounted on the base plate 30*a* of the cassette 30 as located between the printing section and 30*b* and the supply and take-up rolls 33 and 38. It is to be noted that the drive roller 43 is coupled to a driving mechanism (not shown) including a driving motor (not shown) and provided in a printer main body when the cassette 30 is detachably mounted in position in the printer. Thus, when the driving roller 43 receives a driving force transmitted from such a driving mechanism, it is driven to rotate counterclockwise. Also provided in the cassette 30 is a pair of belt rollers 44 and 45 which are freely rotatably supported on respective support arms 46 and 47, which, in turn, are pivotally mounted on the base plate 30*a* of the cassette 30 at a common pivot shaft 48. Each of the support arms 46 and 47 is elongated in shape and its free end is bent upwardly to define a knob 46*a* or 47*a* so that each of the support arms 46 and 47 may be pivotted around the common axis 48 manually by grabbing the corresponding knob 46*a* or 47*a*, for example, by fingers. The belt rollers 44 and 45 may be rotatably mounted on the respective support arms 46 and 47 at appropriate positions, but, in the illustrated embodiment, the belt rollers 44 and 45 are located closer to the free ends of the respective support arms 46 and 47.

As described before, the support arms 46 and 47 may be manually pivotted as indicated by the curved arrows, and the position indicated in FIG. 1 with the support arms 46 and 47 extending straight opposite in direction with respect to the common axis 48 is an operative position in which the belt roller 44 supported on the support arm 46 is located on the opposite side of the supply roll 33 with respect to the driving roller 43 and the other belt roller 45 supported on the support arm 47 is located on the opposite side of the take-up roll 38 with respect to the driving roller 43. Thus, under the condition, an endless, elastic belt 42, preferably comprised of a rubber material, extended around the three rollers 43, 44 and 45 is set in tension because the belt 42 is brought into pressure contact not only with the outer periphery of the supply roll 33 partly, but also with the outer periphery of the take-up roll 38 partly. With this arrangement, when the driving roller 43 is driven to rotate counterclockwise by means of the driving mechanism (not shown) of the printer, the belt 42 advances in the direction indicated by the arrows b so that the print ribbon 32 is unwound from the supply roll 33 to be wound around the take-up roll 38 thereby providing new print ribbon 32 to the printing section 30*b* for use in printing.

When the top cover (not shown) of the cassette 30 is removed from the associated base plate 30*a*, the knobs 46*a* and 47*a* are made accessible so that the support arms 46 and 47 may be pivotted to come closer together in the directions as indicated by the curved lines to a position indicated by the one-dotted line in FIG. 1. The position indicated by the one-dotted line is an inoperative or retracted position where the belt 42 is disengaged from the driving pressure contact from each of the supply and take-up rolls 33 and 38, as will be described more in detail later. Preferably, the cassette 30 is so structured to temporarily hold the support arms 46 and 47 in the operative position indicated by the solid lines and the inoperative position indicated by the one-dotted lines, selectively. Such a holding structure may be easily implemented in various ways as is obvious for one skilled in the art.

Thus, when it is desired to replace the print ribbon 32 currently in use with a new print ribbon, the top cover (not shown) of the cassette 30 is first removed from the base plate 30*a*. Then, for example, by grabbing the knobs 46*a* and 47*a* by fingers, the support arms 46 and 47 are pivotted to be located at the inoperative position as indicated by the one-dotted lines in FIG. 1 so that the driving pressure contact between the belt 42 and each of the supply and take-up rolls 33 and 38 is released. In the illustrated condition, when the support arms 46 and 47 are located at the inoperative position indicated by the one-dotted lines, the belt 42 is completely disengaged from the take-up roll 38, but it is not completely disengaged from the supply roll 33 because a substantial amount of print ribbon 32 remains still wound around the supply reel 31. However, the belt 42 is effectively disengaged from the supply roll 33 as far as driving contact between the belt 42 and the supply roll 33 is concerned. Thus, in accordance with the principle of the present invention, the cassette 30 may be so structured that the belt 42 is disengaged from both of the supply and take-up rolls 33 and 38 when the support arms 46 and 47 are located at the inoperative position or the belt 42 lightly touches either one or both of the supply and take-up rolls 33 and 38 when the support arms 46 and 47 are located at the inoperative position.

Figure 2:
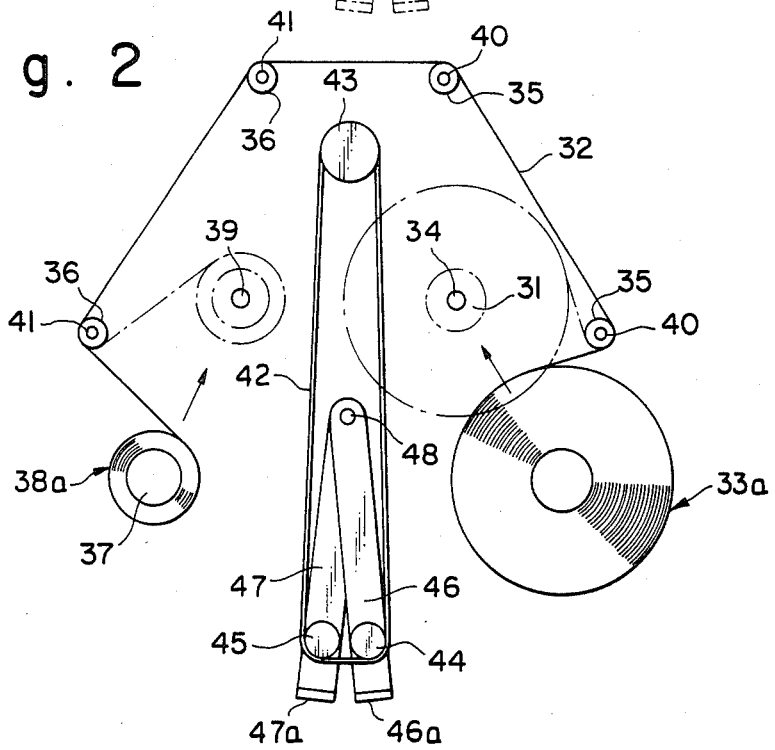
FIG. 2 is a schematic illustration showing the print ribbon replacing condition in the structure shown in FIG. 1.
Figure 3:
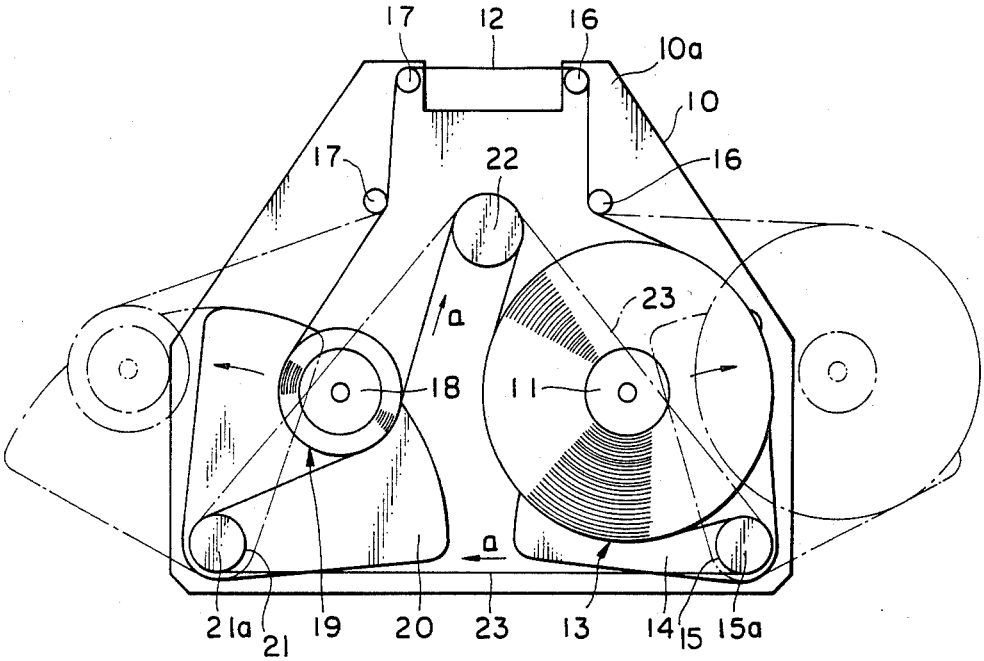
Fig. 3 Prior Art
FIG. 3 is a schematic illustration showing a typical prior art print ribbon replaceable cassette.
Figure 4:
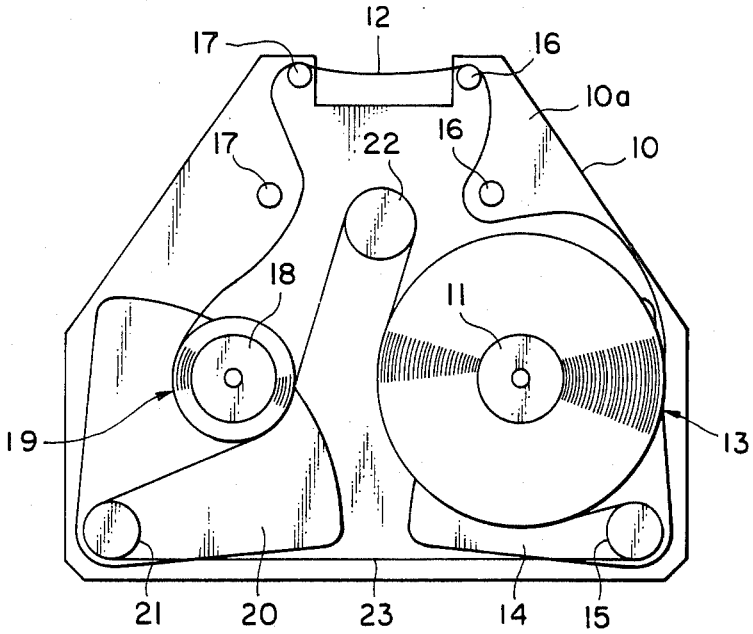
Fig. 4 Prior Art
FIG. 4 is a schematic illustration showing the print ribbon replacing condition in the structure shown in FIG. 3.

Under the condition, both of the supply and take-up rolls 33 and 38 may be removed from the respective shafts 34 and 39 easily and smoothly. And, then, a new print ribbon, for example, wound partly in the form of a supply roll 33*a* and partly in the form of take-up roll 38*a* may be set in position as fitted onto the associated shafts 34 and 39, as indicated by the straight arrows in FIG. 2. Upon setting the new print ribbon in position, the knobs 46*a* and 47*a* are again grabbed by fingers to pivot the support arms 46 and 47 to the original operative position in which the support arms 46 and 47 extend in a line and opposite in direction with respect to the common axis 48. With the support arms 46 and 47 located at the operative position, the belt 42 is brought into driving engagement with both of the supply and take-up rolls 33*a* and 38*a* as being pressed against the outer periphery of each of the rolls 33*a* and 38*a* partly. Then, the top cover is placed in position on the base plate 30*a* to provide the cassette 30 ready to be used in printing operation.

In the above-described embodiment, tne support arms 46 and 47 are provided to be pivotal around the common shaft 48, but, alternatively, the support arms 46 and 47 may be provided to be pivotal around separate pivotal shafts planted in the base plate 30*a* of the cassette 30. Furthermore, in the above-described embodiment, the operative position of the support arms 46 and 47 is defined as a position where the support arms 46 and 47 extend in a line and opposite in direction; however, the operative position may be defined appropriately other than such a straight arrangement. For example, it may be so structured that the support arms 46 and 47 are held in pivotal position to define an angle therebetween other than 180° when located at the operative position.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A print ribbon cassette comprising:

a supply roll of print ribbon detachably and rotatably supported in said cassette;

a take-up roll detachably and rotatably supported in said cassette for taking up the print ribbon unwound from said supply roll;

guide means for guiding the print ribbon unwound from said supply roll to said take-up roll through a printing section where the print ribbon extends exterior of said cassette;

a driving roller provided in said cassette such that said driving roller may be coupled to a driving source of a printer when said cassette is mounted on said printer;

a pair of support arms which are pivotally supported in said cassette and each of which carries thereon a rotatable belt roller; and an endless belt extending around said driving and belt rollers such that said endless belt advances as said driving roller is driven to rotate, wherein said support arms are manually movable between a first position, at which said belt rollers are separated from each other and are substantially at opposite sides of said supply and take-up rolls with respect to said driving roller and said endless belt is in driving engagement with said supply and take-up rolls and a second position, at which said endless belt is effectively disengaged from said supply and take up rolls and said belt rollers are located closer together than when at said first position and said endless belt extends generally straight from said driving roller to said belt rollers between said supply and take-up rolls.

2. The cassette of claim 1 wherein said endless belt is elastic in nature.

3. The cassette of claim 2 wherein said cassette includes a base plate whereby said supply roll is wound around a supply reel which is fitted onto a supply shaft planted in said base plate and said take-up roll is wound around a take-up reel which is fitted onto a take-up shaft planted in said base plate.

4. The cassette of claim 2 wherein said first position is a position in which said pair of support arms extend substantially in a line and opposite in direction thereby locating said pair of belt rollers as separated away from each other.

5. The cassette of claim 4 wherein said pair of support arms is pivotally supported to be pivotal around a common pivot shaft provided in said cassette.

6. The cassette of claim 4 wherein said second position is a position in which said pair of support arms extend substantially in the same direction thereby locating said pair of belt rollers closer together.

7. The cassette of claim 1 wherein each of said pair of support arms is provided with a knob which may be grabbed for providing pivotal movement.

8. The cassette of claim 7 wherein said knob is defined by bending a free end portion of each of the pair of support arms upwardly.

* * * * *